US005581146A

United States Patent [19]

Pribat et al.

[11] Patent Number: 5,581,146

[45] Date of Patent: Dec. 3, 1996

[54] MICROPOINT CATHODE ELECTRON SOURCE WITH A FOCUSING ELECTRODE

[75] Inventors: Didier Pribat, Sevres; Binh V. Thien, Lyons; Pierre Legagneux, Le Mesnil St Denis, all of France

[73] Assignee: Thomson Recherche, Puteaux, France

[21] Appl. No.: 458,821

[22] Filed: Jun. 2, 1995

Related U.S. Application Data

[63] Continuation of Ser. No. 910,071, filed as PCT/FR91/00903 published as WO92/09095 May 29, 1992, abandoned.

[30] Foreign Application Priority Data

Nov. 16, 1990 [FR] France ..... 90 14287

[51] Int. Cl.[6] ..... H01J 1/02

[52] U.S. Cl. ..... 313/309; 313/336; 313/351

[58] Field of Search ..... 313/306, 308, 313/309, 336, 338, 351

[56] References Cited

U.S. PATENT DOCUMENTS

| | | | |
|---|---|---|---|
| 3,748,522 | 7/1973 | Geppert | 313/308 |
| 4,578,614 | 3/1986 | Grey et al. . | |
| 4,874,981 | 10/1989 | Spindt | 313/309 |
| 4,987,377 | 1/1991 | Gray et al. | 313/309 |
| 5,140,219 | 8/1992 | Kane | 313/309 |
| 5,191,217 | 3/1993 | Kane et al. | 313/309 |
| 5,235,244 | 8/1993 | Spindt | 313/309 |
| 5,281,890 | 1/1994 | Kane | 313/309 |

FOREIGN PATENT DOCUMENTS

| | | |
|---|---|---|
| 0278405 | 8/1988 | European Pat. Off. . |
| 0395158 | 10/1990 | European Pat. Off. . |

*Primary Examiner*—Sandra L. O'Shea
*Assistant Examiner*—Vip Patel
*Attorney, Agent, or Firm*—Oblon, Spivak, McClelland, Maier & Neustadt, P.C.

[57] ABSTRACT

Electron source made notably in the form of a micropoint cathode electrode in which a microcathode is located in a cavity (CA) of a dielectric (3). A first gate electrode (VG1) surrounds the cavity (CA) and a second gate electrode (VG2) surrounds the first gate electrode (VG1). The different electrodes are carried to potentials such that the first gate electrode (VG1) acts as an extraction electrode and the second gate electrode acts as a focusing electrode.

9 Claims, 10 Drawing Sheets

SECTION AA'

MICROPOINT CATHODE ELECTRON SOURCE WITH A FOCUSING ELECTRODE

This application is a Continuation of application Ser. No. 07/910,071, filed Apr. 7, 1993, abandoned, which was filed as International Application No. PCT/FR91/00903 on Nov. 15, 1991 published as WO92/09095 May 29. 1992.

BACKGROUND OF THE INVENTION

1. Field of the Invention

The invention relates to a source of electrons and to its manufacturing method.

The invention can be applied to the sector of field effect cathodes and makes it possible to obtain, throughout the surface of the devices in question, an electron emission constituted by parallel beams coming from each micropoint electrode.

2. Discussion of the Background

FIG. 1*a* shows a schematic diagram of a field effect microcathode. Owing to the small dimensions of the basic structure, it is possible to assemble some $10^6$ elements identical to that of FIG. 1*a* per $cm^2$ (see FIG. 1*b*), which may have advantages for electron guns in particular. One of the drawbacks of this type of microcathode lies however in the big aperture of the beam emitted at each point electrode. FIG. 2 gives a schematic view of this situation. Owing to this big aperture at each micropoint electrode, it would appear that it is extremely difficult to be able to focus (see FIG. 3) or process the electron beams emitted from an array of microcathodes such as this, which limits their practical value.

In order to resolve this problem, it has been proposed to add a second gate electrode to the structure of FIG. 1*a*, this second gate electrode being located above the first one and being carried to a lower potential, so as to make the beam extracted from each micropoint electrode (see FIG. 4) parallel (apart from a few aberrations). In this way, it is possible to envisage the focusing of all the beams emitted by an array of microcathodes, by means of a standard electronic optical system (see FIG. 5).

One of the drawbacks of the structure presented in FIG. 4 is that the second electrode is superimposed on the extraction gate and insulated by a second dielectric D2 which should have substantially a thickness equivalent to that of the gate dielectric D1, given the focusing voltages that are liable to be used. For gate diameters of the order of one micron, it is possible that (owing to the big aperture of the emitted beam) there could be an interception of a non-negligible part of the current emitted at each micropoint electrode both by the dielectric D2 supporting the focusing electrode G2 and by this same focusing electrode. With respect to the dielectric D2, this may lead firstly to problems of the emission of secondary electrons which would be parasitic with respect to the main beam and, secondly, problems of the appearance of localized electrostatic charges capable of locally deforming each emitted microbeam. With respect to the focusing electrode G2, the interception of excessive current could quite simply lead to its destruction. One way of overcoming the problem is, naturally, to position the dielectric D2 and the electrode G2 in a recessed position with respect to the opening of the gate, as shown in FIG. 6.

However, the uniform control of this recess on substantial surface areas (of the order of one to several square centimeters) does not seem to be as easy to obtain, and the present invention provides a different approach to resolving this problem of focusing.

SUMMARY OF THE INVENTION

The invention provides the interposition of a second electrode, coplanar with the grid electrode, the polarity of which is adapted so as to enable the focusing of each microbeam.

The invention therefore relates to an electron source comprising, on a substrate, a dielectric layer comprising at least one cavity in which there is located a cathode electrode in the form of a projection, a first gate electrode being located on the upper face of the dielectric layer and at least partially surrounding the cavity, characterized in that said source comprises at least one second gate electrode located on the same side as the first gate electrode with respect to the upper face of the dielectric layer, the first gate electrode being located between the cavity and the second gate electrode.

The invention also relates to a method for the making of electron sources, characterized by the fact that at least one layer of dielectric material is deposited on a substrate, at least one cavity is etched in the deposited layer and there is formed, by growth on the substrate, a projecting cathode electrode at the bottom of each cavity, a first gate electrode being formed on the layer of dielectric material around each cavity and a second gate electrode being formed around the first gate electrode.

BRIEF DESCRIPTION OF THE DRAWINGS

The different objects and features of the invention shall appear more clearly in the following description, and from the appended figures, of which.

DESCRIPTION OF THE PREFERRED EMBODIMENTS

Figure 1A:
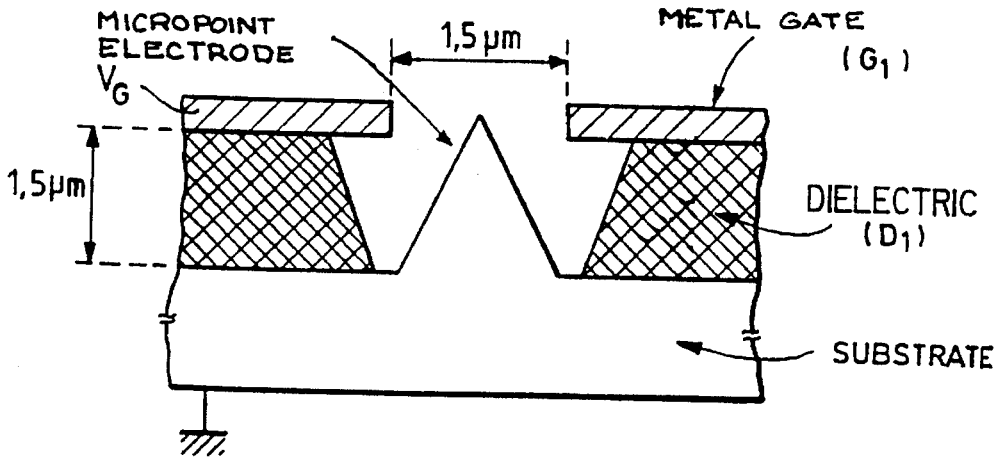
FIG. 1a PRIOR ART
—FIGS. 1*a* to 6 show prior art techniques already described here above.
Figure 1B:
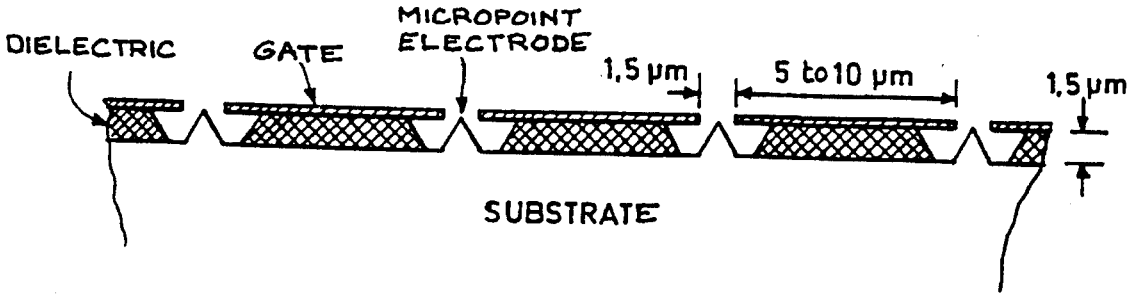
FIG. 1b PRIOR ART
Figure 2:
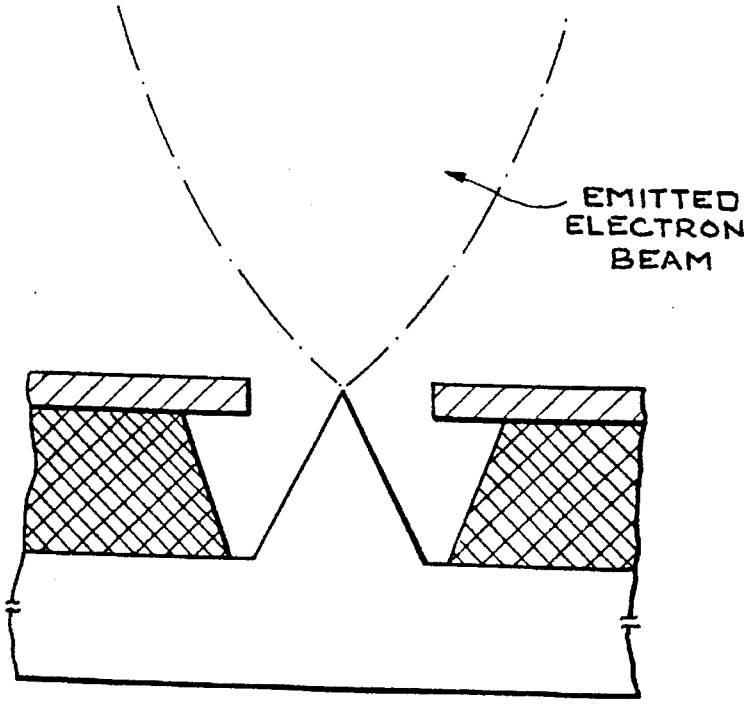
FIG. 2 PRIOR ART
Figure 3:
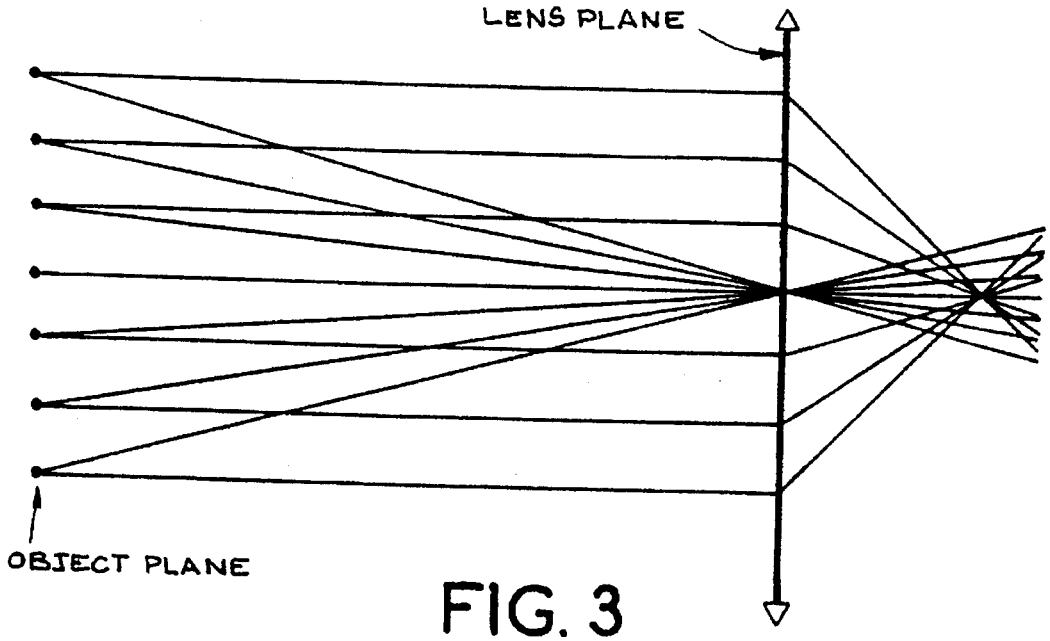
FIG. 3 PRIOR ART
Figure 4:
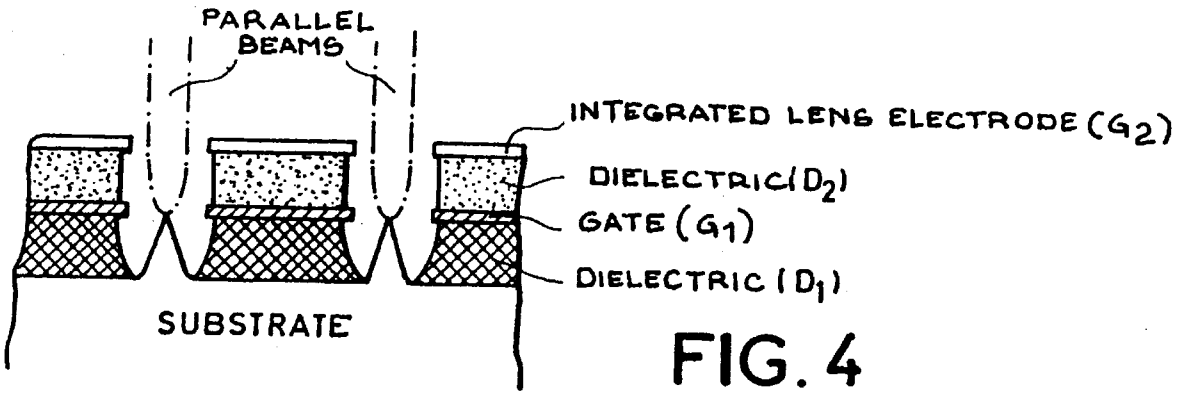
FIG. 4 PRIOR ART
Figure 5:
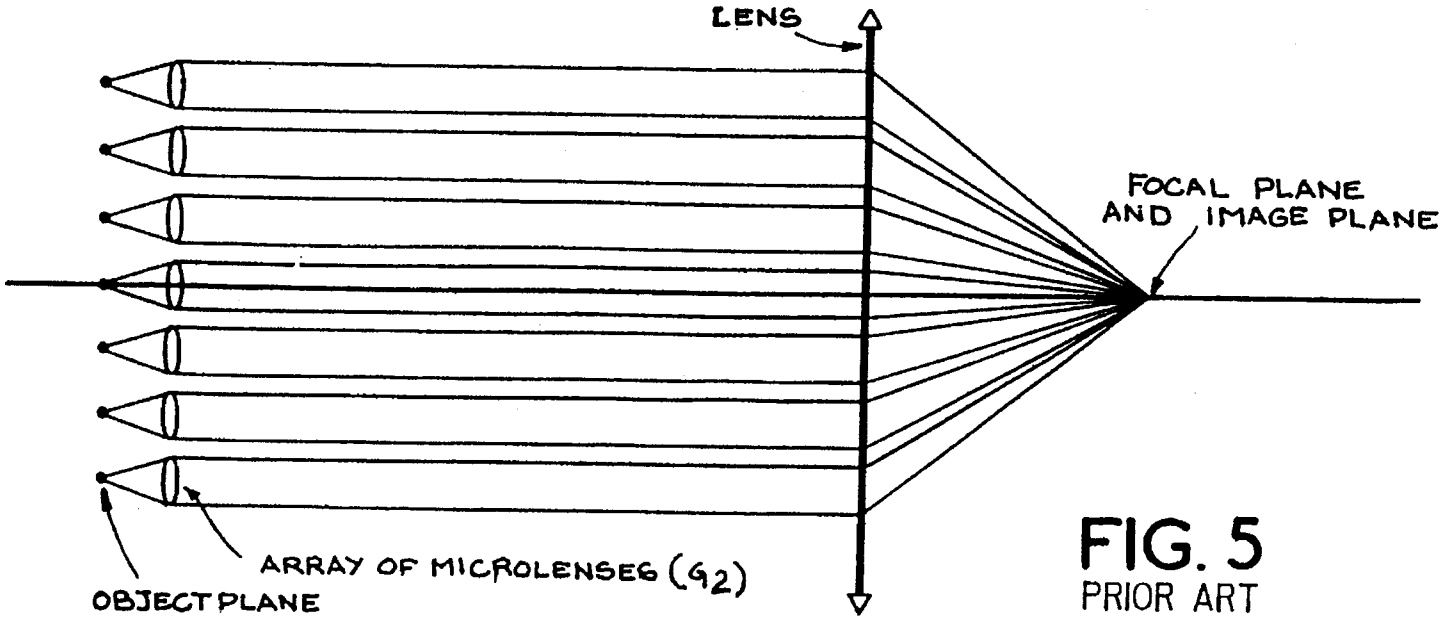
FIG. 5 PRIOR ART
Figure 6:
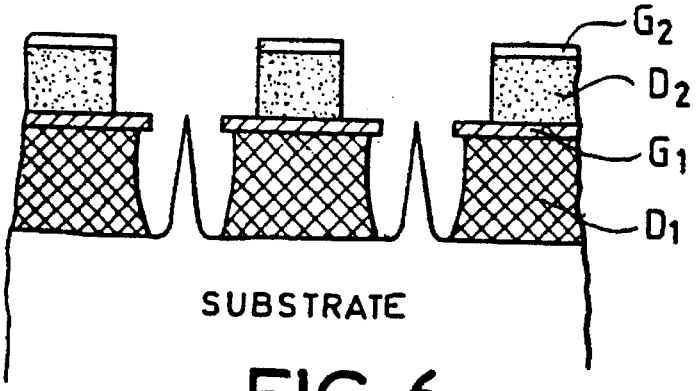
FIG. 6 PRIOR ART
Figure 7:
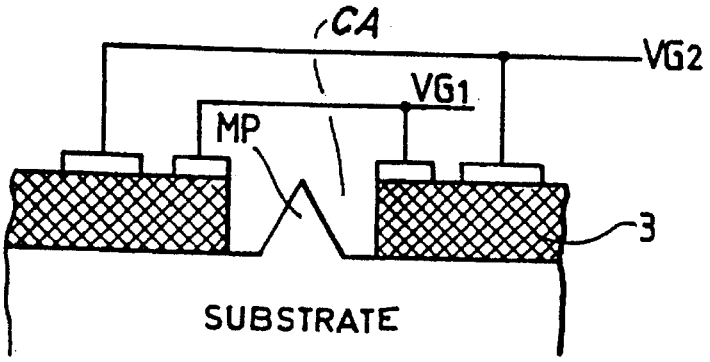
—FIG. 7 shows an exemplary embodiment of an electron source according to the invention.

According to the invention, there is proposed the use of a focusing electrode that is no longer superimposed on the gate electrode as in FIGS. 4 to 6, but has coplanar focusing electrodes as shown in FIG. 7. The coplanar electrodes are gate electrodes VG1 and VG2 located on the layer of dielectrics and surrounding the cavity CA in which there is located a microcathode MP. The gate VG1 serves as a gate for the extraction of the electrons and the gate VG2 serves as a focusing gate.

According to one alternative embodiment, the second gate electrode VG2 partially surrounds the first gate electrode VG1. According to another variant, the second gate electrode VG2 entirely surrounds the unit formed by the cavity CA and the first electrode VG1.

A self-aligned method of manufacture for such a device shall now be described.

Starting from a substrate 1, typically made of silicon (100) on which there is successively deposited an $Si_3N_4$ layer 2 (thickness of 0.1 μm), an $SiO_2$ layer 3 (with a thickness of 1 μm) and a highly doped (some $10^{31\ 3}$ ohm.cm) layer 4 of small-particle polycrystalline silicon, i.e. obtained by a CVD (chemical vapor deposition) process at low temperature (and hence preferably at reduced pressure, typically in the range of 10–300 torrs).

Figure 8A:
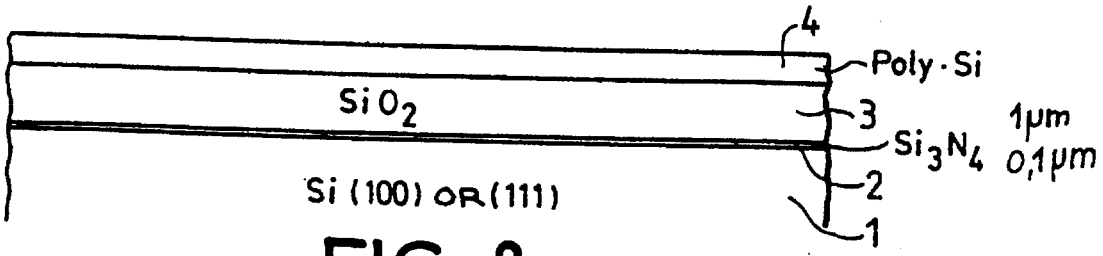
—FIGS. 8*a* to 8*k* show different steps of a method of manufacture according to the invention.

The layers shown in FIG. 8*a* are obtained.

It will be noted that the starting substrate used could also be a silicon wafer of the SOI (silicon on insulator) type obtained by a SIMOX type process (by carrying out a dual ion implantation of nitrogen followed by oxygen) or else by a method of recrystallization in liquid phase (for the details of these different methods, the following may be consulted: *IEEE Circuit and Device Magazine,* Vols. 3 and 4, July and November 1987).

The advantage of an SOI wafer is that silicon on insulator is monocrystalline. The rest of the method shall be described in assuming that the starting step is that of a deposition of polycrystalline silicon.

Figure 8B:
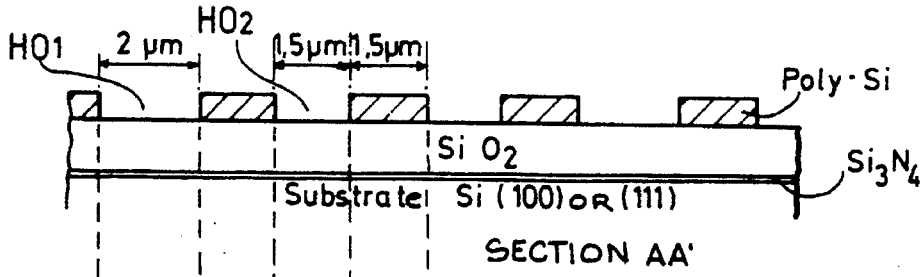
Figure 8C:
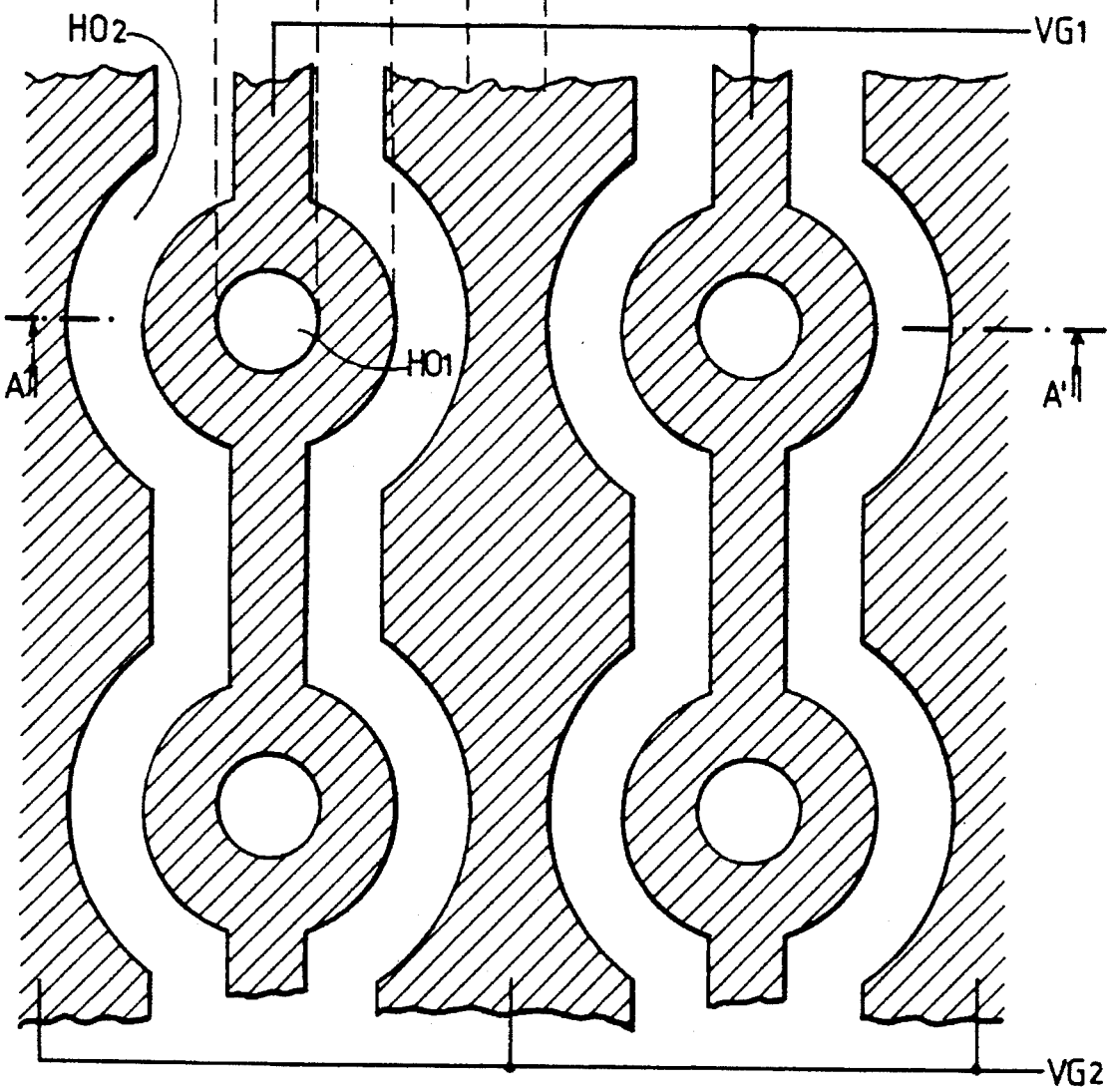

The pattern shown in FIGS. 8*b* and 8*c*, in a sectional view and in a top view, is etched in the layer 4 of silicon on insulator 3. This will be the only masking step of the method (see here below). Thus at least one first opening HO1 is etched in the layer of semiconducting or conducting material 4 and a second opening HO2 surrounding the first opening HO1, the width of the etching of the first opening being greater than that of the etching of the second opening. It will be noted that this is not submicronic etching and that, consequently, the prior operation of lithography can be done in a standard optical manner, which is an advantage.

Further below, a description shall be given of a variant of the method requiring, for example, an electronic masking.

An operation for the selective deposition of silicon is then made.

Figure 8D:
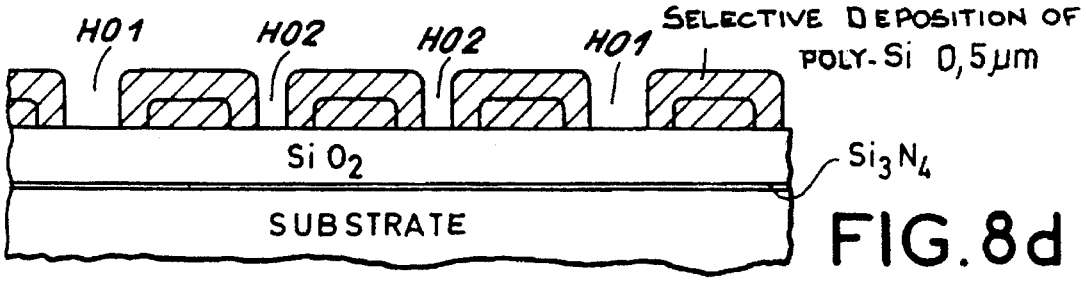

This operation is done by CVD in using a mixture of $SiH_4$+HCl or else $SiH_2Cl_2$+HCl as reagent gases. If polycrystal is deposited, the operation will be done at low temperature and hence, preferably, at reduced temperature. This operation is shown in FIG. 8*d*.

The deposit obtained is oxidized so as to make the smallest gaps (see FIG. 8*e*) join one another (by silica) but in leaving evenly spaced out openings at the larger sized places. The mask of FIGS. 8*a* and 8*c* is adapted to this effect (typical dimensions of 1.5 and 2 μm respectively).

Figure 8E:
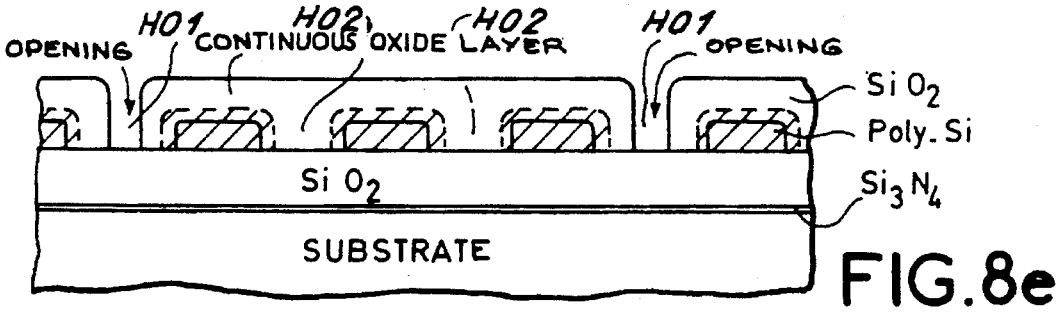
Figure 8F:
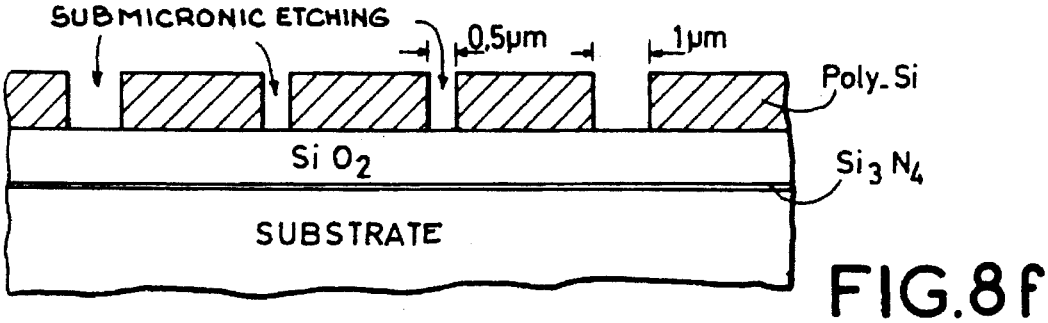

A variant shown in FIG. 8*f* consists in using a starting layer of silicon that is thicker (for example 1 μm) and in directly making a submicronic etching (etching of 0.5 μm for example) at the places where it is desired that the two oxidation edges should meet. After oxidation, a structure similar to that of FIG. 8*e* is obtained. The drawback is the obligation to use the electron masking step associated with the obtaining of submicronic patterns (0.5 μm etchings ); by contrast, it is thus possible to avoid the step of selective epitaxy of FIG. 8*d*.

Figure 8G:
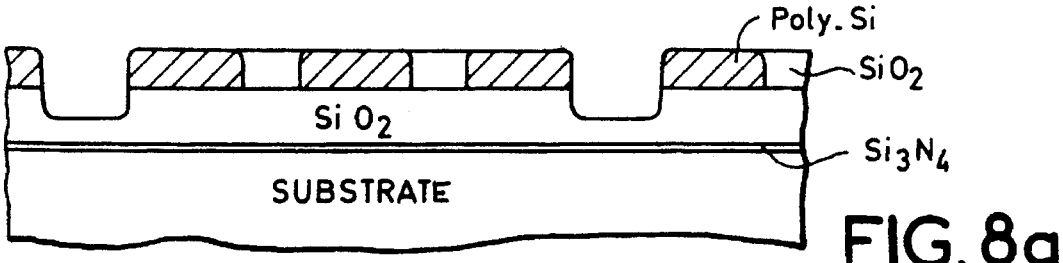

Then a reactive ion etching (RIE) operation is carried out in using the previously formed $SiO_2$ as a mask. The etching is stopped when the pads of poly-si become visible (FIG. 8*g*).

Figure 8H:
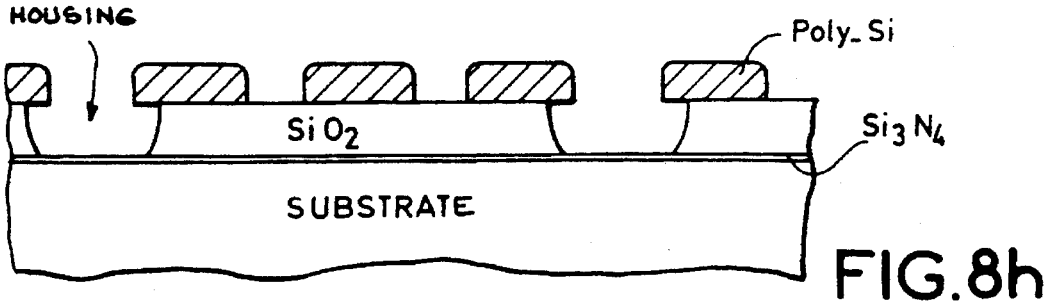

A chemical attacking operation is then carried out in a buffered HF bath so as to make the housings, shown in FIG. 8*h*, in the insulator layer 3. At the same time, the silica made during the preceding oxidation (FIG. 8*c*) is eliminated from the upper part.

Figure 8I:
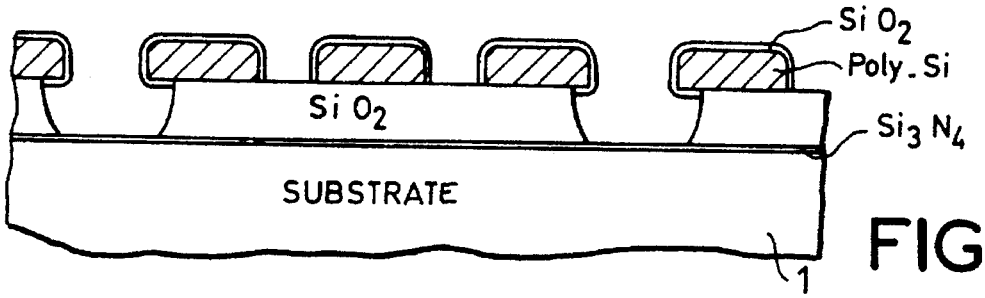

A slight oxidation is then carried out again on the pads of polycrystalline silicon so as to passivate the crystalline surfaces (FIG. 8*i*).

It will be noted that the Si substrate protected by the $Si_3N_4$ layer is not oxidized during this treatment.

Figure 8J:
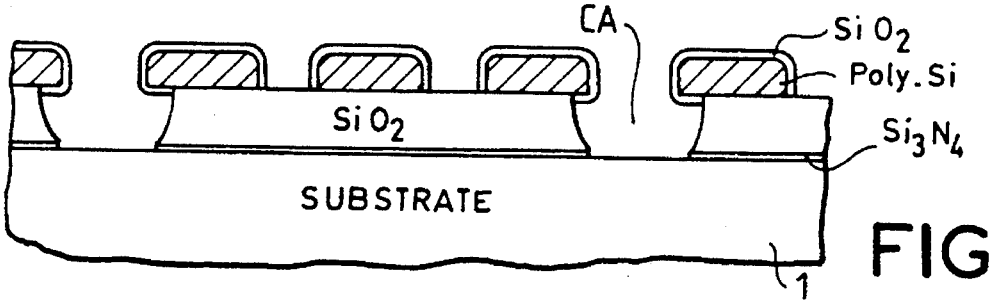

The $Si_3N_4$ is eliminated from the housings (by selective chemical attacking with $H_3PO_4$ for example) so as to locally bare the Si substrate (FIG. 8*j*).

Figure 8K:
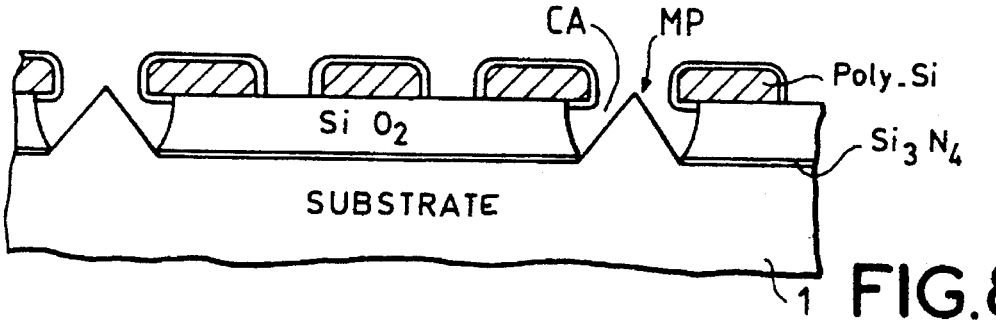

Then, in the previously defined microhousings, and using bared substrate seeds, an operation of facetted and localized crystal growth is carried out under conditions of selective epitaxy (se FIG. 8*k*). This type of operation is described in detail in the French patent applications Nos. 89 03949 and 89 03153. For example, this epitaxy may be done in an MOCVD (metalorganic chemical vapor deposition) reactor at reduced pressure.

For example, for a silicon substrate, this growth may be done by selective epitaxy in a CVD reactor at a temperature of 900° to 1100° C., using a gas mixture comprising $SiH_4$+HCl or $SiH_2Cl_2$+HCl in carrier hydrogen. For an GaAs substrate, this selective epitaxy may be done between 600° and 800° C. in a VPE reactor in using a gas mixture comprising $AsCl_3$ diluted in $H_2$ and a solid gallium source.

When the facetting of the cathode point electrode to be obtained does not enable (111) planes to be obtained, a subsequent selective chemical attacking is carried out on the point electrode so as to obtain this (111) facetting.

Figure 9:
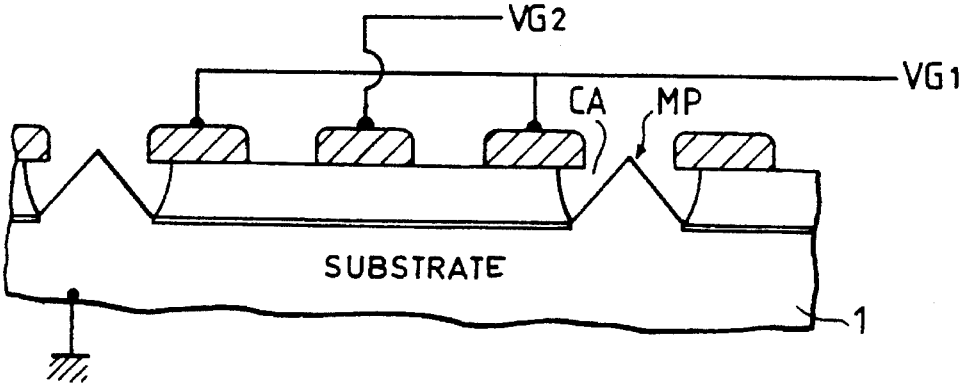
—FIG. 9 shows an example of a control assembly of a source according to the invention.

The passivation $SiO_2$ is then eliminated so as to obtain the structure shown in FIG. 9 wherein the necessary biases are also indicated.

Figure 12A:
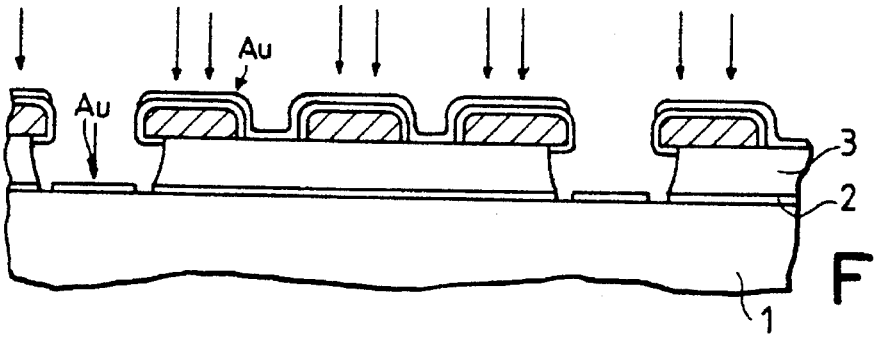
—FIGS. 12*a* to 12*e* show a variant of the manufacturing method according to the invention.
Figure 12B:
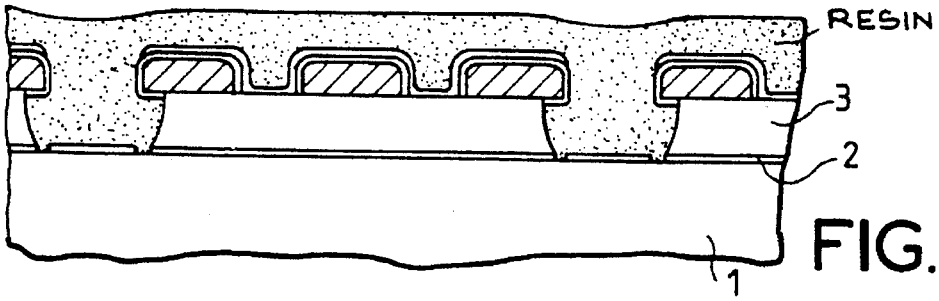

It is also possible, in the microhousings of FIG. 8*j*, to carry out a "whiskers" type crystalline growth as described in the French patent application No. 90 02258 dated 23rd Feb. 1990. To do this, a prior deposition is made in the microhousings, of a thin layer of gold or gallium or any other material known to those skilled in the art and capable of forming an eutectic composition with silicon. This deposition can be done in the manner shown in FIGS. 12*a* to 12*e*. The operation starts with the uniform deposition of a layer of gold for example, in using a method such as cathode sputtering or vacuum evaporation (FIG. 12*a*). A liquid resin (of the photoresist type) is then deposited, and the operation may be preceded by a surface-active treatment (by means of a primer) in order to enable the resin to properly penetrate the microhousings (FIG. 12*b*). This resin is then polymerized at 70° to 120° C. depending on the type used.

Figure 12C:
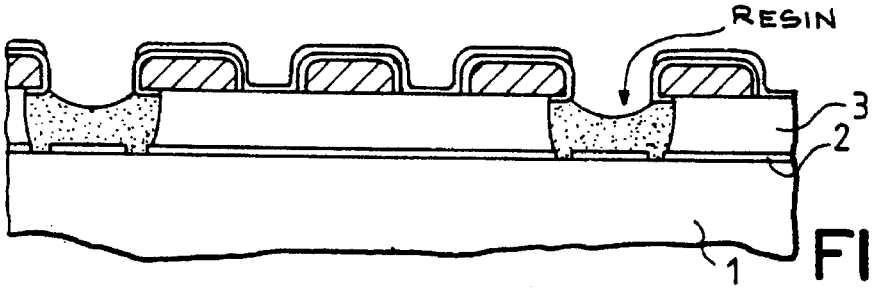

The resin is then subjected to chemical attacking in an oxygen-based plasma so as to eliminate the upper part of the device, but in preserving it in the microhousings so as to protect the gold film in contact with the substrate (FIG. 12*c*).

Figure 12D:
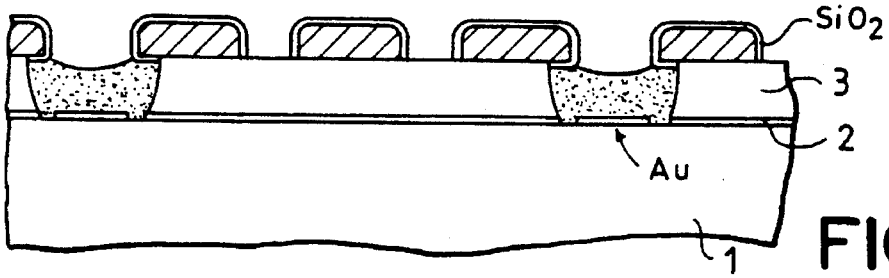
Figure 12E:
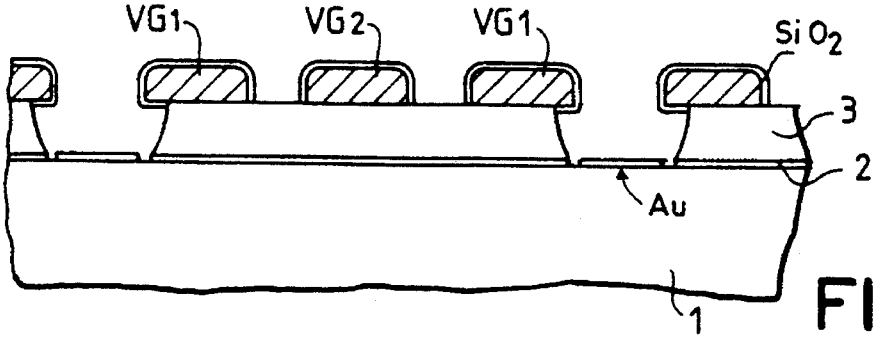

The gold of the upper part of the device is eliminated (by means of a solution of $I_2$/KI for example), the film that is in contact with the substrate (and masked by the resin ) being protected (FIG. 12*d*).

The resin in the microhousings is then eliminated (by means of an appropriate solvent) and conditions are now ready for a "whiskers" type growth as described in the French patent No. 90 02258.

A variant shall how be described enabling the obtaining of a slightly different structure that improves the focusing of the electron beam emitted by each point electrode.

This variant is described in FIG. 10.

Figure 10A:
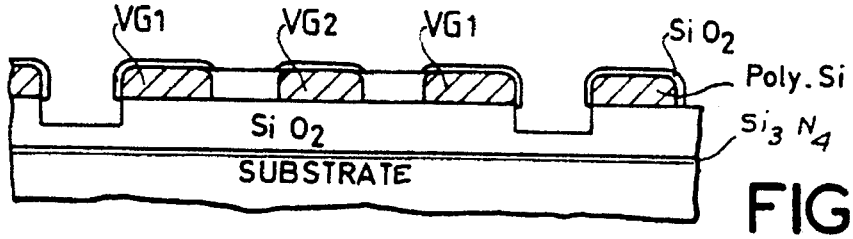
—FIGS. 10*a* to 10*d* show steps of a method for making a variant according to the invention.
Figure 10B:
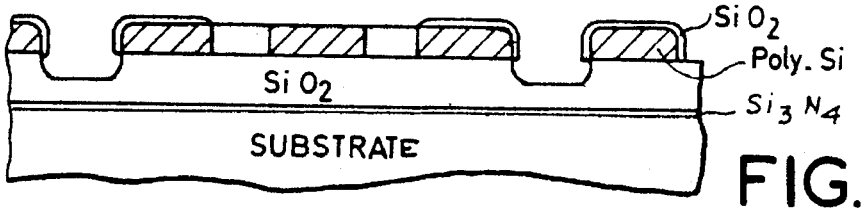

The structure at the start is that of FIG. 8*g* and the operation begins with the slight oxidation of the surface polysilicon (see FIGS. 10*b*).

A second masking is carried out so as to eliminate this oxide on the VG2 type pads (see FIGS. 10*b*).

It will be seen that this masking operation is not a particularly delicate one since it requires no precise alignment. Indeed, it is enough for the two pads VG1, adjacent to the VG2 type pads, to be masked. The boundary of the mask may lie somewhat anywhere on the silica between the pads VG2 and VG1.

Figure 10C:
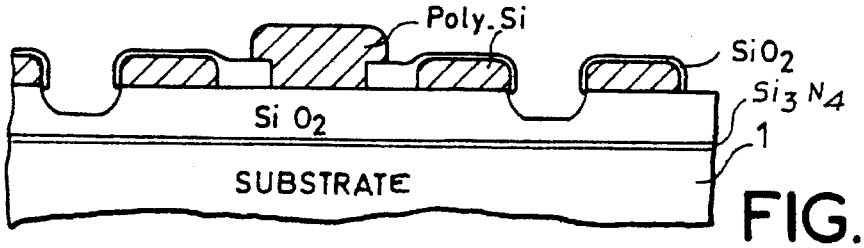

Once the VG2 type pads have been bared (the VG1 type pads being still masked by the silica), a second operation of selective epitaxy is carried out (of the type described in relation with FIG. 8*d*) so as to obtain the structure shown in FIG. 10*c*. The upper plane of the VG2 type pad is raised with respect to the upper plane of the VG1 type pads. In addition, during this operation, a lateral growth of VG2, equivalent to the vertical growth (0.5 μm in FIG. 10*c*), has been obtained.

Figure 10D:
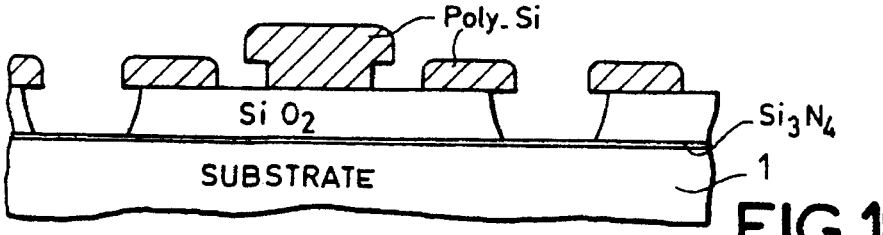

The silica of the upper part located between the pads VG1 and VG2 is then removed while at the same time carrying out the operation for the formation of the microhousings (FIG. 10*d*).

The remaining operations described with reference to FIGS. 8*i* to 8*k* are then carried out so as to obtain a final structure of the type shown in FIG. 11.

Figure 11:
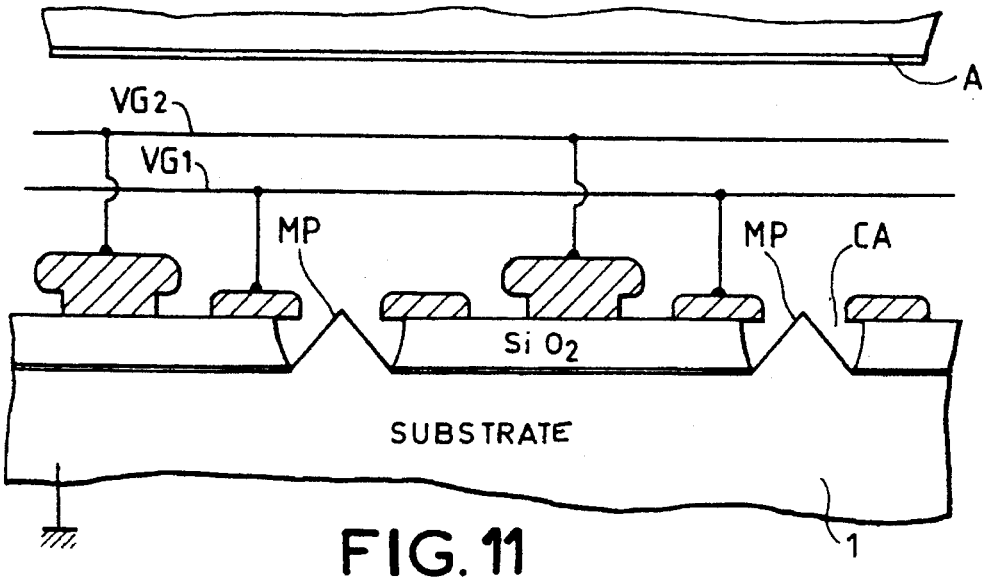
—FIG. 11 shows a variant of an electron source according to the invention.

FIGS. 9 and 11 also show examples of electrical assemblies of the device according to the invention.

The device of FIG. 11 has been provided with an added anode A positioned so as to face micropoint electrodes such as MP. An emission of electrons may therefore take place between a micropoint electrode MP and the anode A.

For this purpose, one or more voltage sources apply determined potentials to a micropoint electrode MP, a gate VG1, a gate VG2 and the anode A.

For example, if a micropoint electrode is placed at a reference potential VR, the other potentials are respectively the following:

—gate VG1: potential higher than the reference potential VR;

—gate VG2: potential lower than the reference potential VR;

—anode A: potential higher than that of VG1.

Under these conditions, there will be obtained, for example, a focusing, on the anode, of an electron beam emitted by a micropoint electrode or else a parallel beam.

Figure 13A:
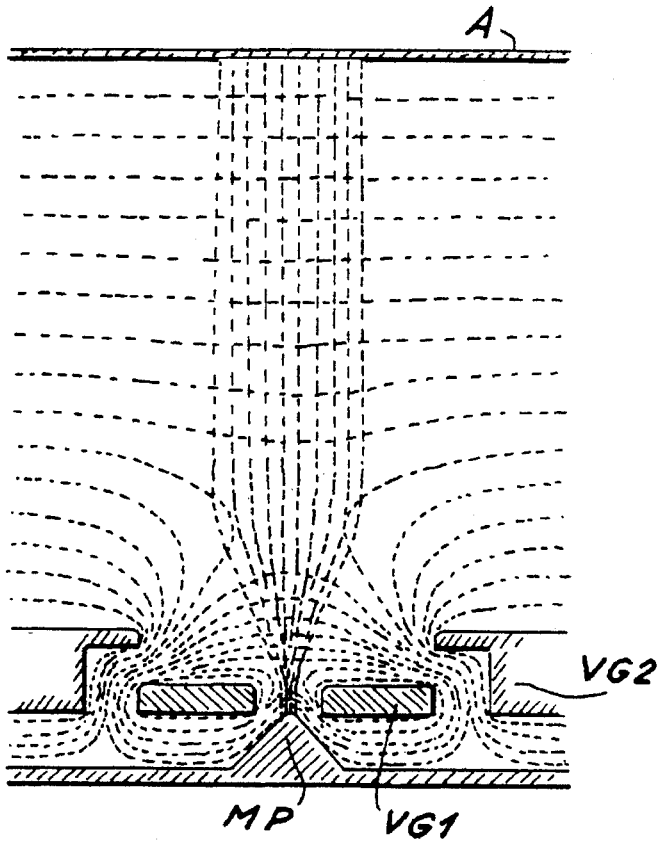
—FIGS. 13*a* and 13*b* show examples of curves of emissions in a device according to the invention.

By modelization, a parallel electron beam of the type shown in FIG. 13*a* has been obtained, with the following voltage conditions:

—micropoint electrode MP: at 0 volts

—gate VG1: 100 volts

—gate VG2: −50 volts

—anode A: 110 volts.

Figure 13B:
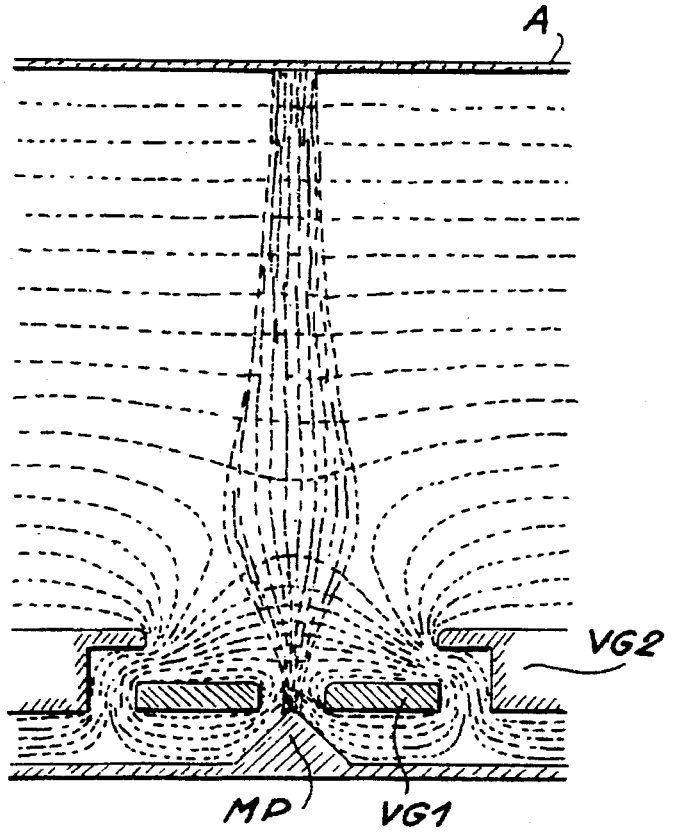

A focused beam of the type shown in FIG. 13*b* has also been obtained with the following conditions:

—micropoint electrode MP: at 0 volts

—gate VG1: 100 volts

—gate VG2: −60 volts

—anode A: 110 volts.

It is clear that the above description has been made purely by way of an example, and that other variants may be envisaged without departing from the framework of the invention. In particular, the order in which the operations of the methods described are carried out may be changed and the types of materials used may be different from those indicated here above. For example, it is possible to use any semiconductor material other than silicon. The dimensions of the layers and of the etchings as well as the operating conditions may be changed.

We claim:

1. A device for generating and focusing an electron beam, comprising:

a semiconducting substrate having a semiconducting substrate upper surface;

a dielectric layer on the semiconducting substrate having a dielectric layer lower surface facing the semiconducting substrate upper surface, a dielectric layer upper surface opposite to the dielectric layer lower surface, and a generally cylindrical surface defining a passage extending from the dielectric layer upper surface to the semiconducting substrate upper surface, said passage having a passage upper perimeter at the dielectric layer upper surface;

a micropoint cathode electrode that is electrically connected to the semiconducting substrate and projecting from the semiconducting substrate upper surface inside the passage, said micropoint cathode electrode having a relatively wide base connecting to the substrate upper surface and a relatively pointy tip that is above the base;

means for controlling emission of electrons from the micropoint cathode electrode, comprising a grid electrode disposed on the upper surface of the dielectric layer and at least partially surrounding said passage upper perimeter, and means for biasing the grid electrode and the micropoint cathode electrode such that a grid voltage on the grid electrode is greater than a micropoint cathode electrode voltage on the micropoint cathode electrode;

means for focusing electrons emitted by the micropoint cathode electrode, comprising a focusing electrode disposed upon the dielectric layer upper surface that at least partially surrounds the micropoint cathode electrode, but which is further away from the micropoint cathode electrode than the grid electrode, and biasing means, coupled to the means for controlling, for biasing the focusing electrode to a focusing electrode voltage that is lower than the grid voltage, for focusing electrons emitted by the micropoint cathode electrode, the focusing electrode being of a mushroom shape having an upper plane portion raised with respect to an upper plane of the grid electrode and the focusing electrode having an extended lateral portion with respect to the grid electrode;

wherein application of the grid voltage to the grid electrode, the micropoint cathode electrode voltage to the micropoint cathode electrode, and the focusing electrode voltage to the focusing electrode, results in emission of a beam of electrons by the micropoint cathode electrode and focusing of the beam of electrons by the focusing electrode, resulting in a beam of focussed electrons.

2. The device according to claim 1, wherein the focusing electrode has a focusing electrode lower surface that is in contact with the dielectric layer upper surface and the grid electrode has a grid electrode lower surface that is in contact with the dielectric layer upper surface and the grid electrode lower surface and the focusing electrode lower surface are coplanar.

3. A device according to claim 2, wherein the focusing electrode and the grid electrode are in the form of layers and have different thicknesses.

4. A device according to claim 3, wherein the focusing electrode is thicker than the grid electrode and has a portion that is located directly above a portion of the grid electrode.

5. A device according to claim 1, wherein the focusing electrode partially encircles the grid electrode.

6. A device according to claim 1, wherein the grid electrode encircles the passage upper perimeter in the plane formed by the dielectric layer upper surface and the focusing electrode encircles the grid electrode in the plane formed by the dielectric layer upper surface.

7. A device according to claim 1, further comprising:

an anode; and means, coupled to the means for controlling emission of electrons from the micropoint cathode electrode, for biasing the anode to a potential that is greater than the potential of the grid electrode.

8. A device according to claim 1, wherein a portion of the grid electrode overhangs a portion of the passage upper perimeter.

9. A device according to claim 1, wherein the grid electrode encircles the passage upper perimeter and overhangs all portions of the passage upper perimeter.

* * * * *